US010268160B2

(12) United States Patent
Miyazaki

(10) Patent No.: US 10,268,160 B2
(45) Date of Patent: Apr. 23, 2019

(54) EXHAUST AND FILTER APPRATUS AND IMAGE FORMING APPARATUS COMPRISING THE SAME

(71) Applicant: KYOCERA Document Solutions Inc., Osaka (JP)

(72) Inventor: Tadashi Miyazaki, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 16/014,472

(22) Filed: Jun. 21, 2018

(65) Prior Publication Data

US 2019/0011879 A1 Jan. 10, 2019

(30) Foreign Application Priority Data

Jul. 6, 2017 (JP) ..... 2017-133104

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01)

(58) Field of Classification Search
CPC ..... G03G 21/206; G03G 15/2017
See application file for complete search history.

(56) References Cited

U.S. PATENT DOCUMENTS 9,256,201 B2 * 2/2016 Satou ..... G03G 21/206
10,001,747 B1 * 6/2018 Tamura ..... G03G 15/2017
2005/0271414 A1 * 12/2005 Katayama ..... G03G 15/0258 399/93
2011/0211860 A1 9/2011 Shimoyama et al.

FOREIGN PATENT DOCUMENTS

JP 2011-180236 A 9/2011

* cited by examiner

*Primary Examiner* — Rodney A Bonnette
(74) *Attorney, Agent, or Firm* — IP Business Solutions, LLC

(57) ABSTRACT

An image forming apparatus includes: an image formation section, a fan, a filter, a contamination detection section, an exhaust path, a circulation path, an air amount adjustment section, and a control section. The fan suctions and exhausts air at surroundings of the image formation section. The filter permits the air exhausted by the fan to pass through the filter. The contamination detection section detects a contamination level of the air which has passed through the filter. The exhaust path discharges the air to an outside. The circulation path returns the air towards a suction side of the fan. The air amount adjustment section increases and decreases an amount of the air flowing through the exhaust path and an amount of the air flowing through the circulation path oppositely to each other. The control section controls the air amount adjustment section in accordance with the contamination level of the air.

10 Claims, 4 Drawing Sheets

EXHAUST AND FILTER APPRATUS AND IMAGE FORMING APPARATUS COMPRISING THE SAME

INCORPORATION BY REFERENCE

This application claims priority to Japanese Patent Application No. 2017-133104 filed on 6 Jul., 2017, the entire contents of which are incorporated by reference herein.

BACKGROUND

This disclosure relates to an image forming apparatus forming a toner image on recording paper, and more specifically to a technology for preventing leakage of particles of, such as a toner, to an outside.

In a typical image forming apparatus, a duct is arranged near a heating roller for fixing a toner image on recording paper, a filter member and an exhaust fan are provided inside of the duct, the exhaust fan is driven, fine particles generated from the heating roller are taken into the duct, the fine particles are captured by the filter member, and a rotation speed of the exhaust fan is controlled in accordance with initial burst condition in which the fine particles are discharged. The initial burst condition includes conditions based on passage time from start of power introduction of the image forming apparatus, time which has passed since recovery from a standby state, a temperature of the heating roller, and so on.

SUMMARY

A technology obtained by further improving the technology described above will be suggested as one aspect of this disclosure.

An image forming apparatus according to one aspect of this disclosure includes: an image formation section, a fan, a filter, a contamination detection section, an exhaust path, a circulation path, an air amount adjustment section, and a control section. The image formation section forms a toner image on recording paper. The fan suctions and exhausts air at surroundings of the image formation section for ventilation. The filter permits the air exhausted by the fan to pass through the filter. The contamination detection section detects a contamination level of the air which has passed through the filter. The exhaust path discharges the air, which has passed through the filter, to an outside. The circulation path returns the air, which has passed through the filter, towards a suction side of the fan without discharging the air to the outside. The air amount adjustment section increases and decreases an amount of the air flowing through the exhaust path and an amount of the air flowing through the circulation path oppositely to each other. The control section controls the air amount adjustment section in accordance with the contamination level of the air detected by the contamination detection section to increase and decrease the amount of the air flowing through the exhaust path and the amount of the air flowing through the circulation path oppositely to each other.

DETAILED DESCRIPTION

Hereinafter, an embodiment of this disclosure will be described with reference to the drawings.

Figure 1:
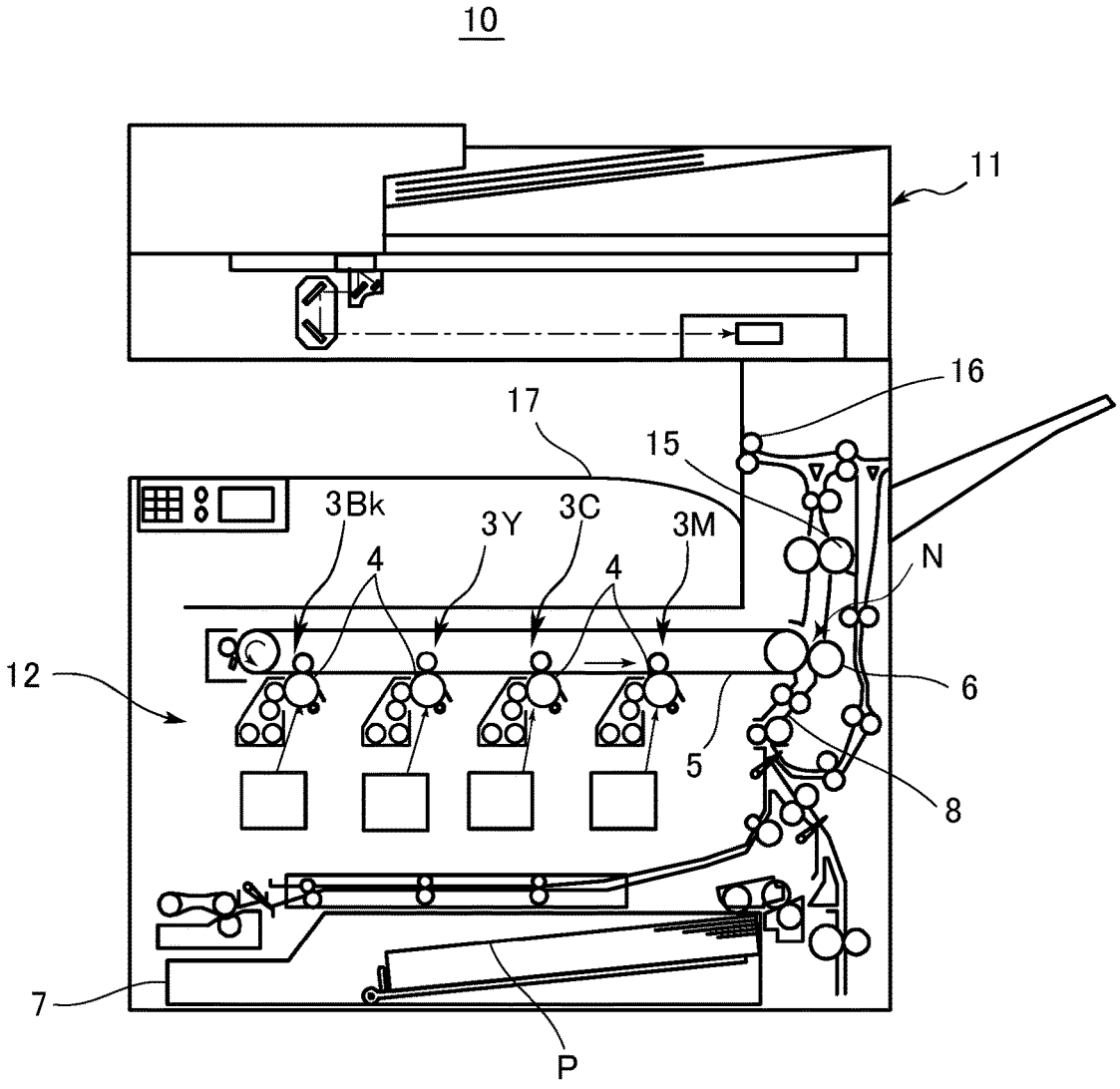
FIG. 1 is a front sectional view illustrating a structure of an image forming apparatus according to one embodiment of this disclosure.

FIG. 1 is a front sectional view illustrating a structure of an image forming apparatus according to one embodiment of this disclosure. An image forming apparatus 10 of this embodiment is a multifunction peripheral (MFP) including a combination of a plurality of functions such as a copy function, a printer function, a scanner function, and a facsimile function. The image forming apparatus 10 includes an image reading section 11, an image formation section 12, etc.

The image reading section 11 has a scanner which optically reads a document, and generates image data indicating an image of the document.

The image formation section 12 prints, on recording paper, an image indicated by the image data generated by the image reading section 11 or image data received from an outside, and includes a magenta image formation unit 3M, a cyan image formation unit 3C, a yellow image formation unit 3Y, and a black image formation unit 3Bk. In each of the image formation units 3M, 3C, 3Y, and 3Bk, a surface of a photoconductive drum 4 is uniformly charged and the surface of the photoconductive drum 4 is exposed to form an electrostatic latent image on the surface of the photoconductive drum 4, and then the electrostatic latent image on the surface of the photoconductive drum 4 is developed into a toner image, which is then transferred onto an intermediate transfer belt 5. Consequently, a color toner image is formed on the intermediate transfer belt 5. At a nip area N formed between the intermediate transfer belt 5 and a secondary transfer roller 6, the color toner image is secondarily transferred onto recording paper P conveyed from a paper feed section 7 through a conveyance path 8.

Then the recording paper P is heated and pressurized in a fixing device 15, the toner image on the recording paper P is fixed through thermocompression, and the recording paper P is further discharged onto a discharge tray 17 through a discharge roller pair 16.

It is required to prevent leakage of particles, such as a non-transferred toner which could not be collected and ultrafine particles released from a component material exposed to a high temperature, to an outside in such an image forming apparatus 10. Moreover, a fixing temperature of the toner image formed on the recording paper needs to be decreased to decrease power consumption and a toner melting point is set low, thus requiring efficient cooling of an inside of the image forming apparatus 10. Thus, a fan and a filter are provided inside of the image forming apparatus 10, so that the particles such as the non-transferred toner and the ultrafine particles are taken in and captured by the fan and the filter and the inside of the image forming apparatus 10 is cooled.

In the image forming apparatus 10, the particles such as the non-transferred toner and the ultrafine particles are released from the image formation section 12 and the toner image is formed onto the recording paper by the image formation section 12, so that it is required to capture the particles released from the image formation section 12 and also sufficiently cool the image formation section 12.

Figure 2:
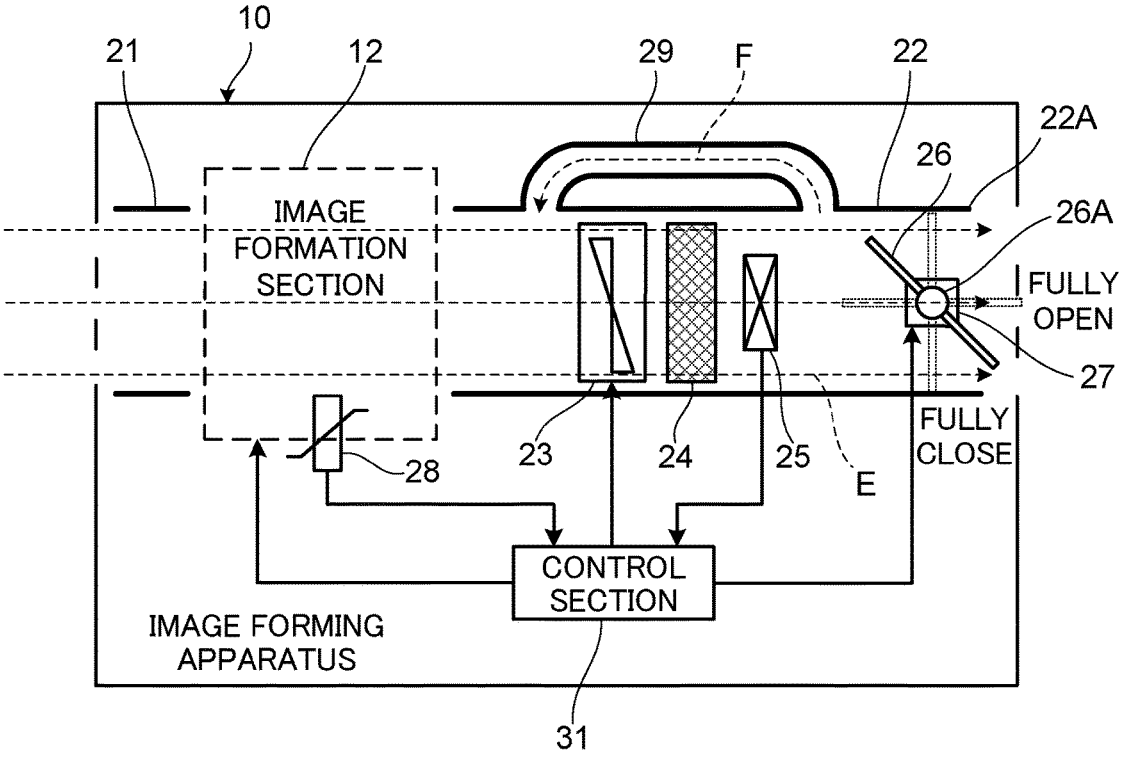
FIG. 2 is a sectional view schematically illustrating a ventilation mechanism of an image formation section in the image forming apparatus of this embodiment.

FIG. 2 is a sectional view schematically illustrating a ventilation mechanism of the image forming apparatus 10. In the ventilation mechanism as illustrated in FIG. 2, a suction side duct 21 and an exhaust side duct 22 are provided in a manner such as to sandwich the image formation section 12 therebetween, a fan 23, a filter 24, and a fine particle sensor 25 are arranged in series inside of the exhaust side duct 22, and a first opening and closing valve 26 is provided at an exhaust port 22A of the exhaust side duct 22. Note that the filter 24, the fan 23, and the fine particle sensor 25 may be arranged in order just mentioned, or the filter 24, the fine particle sensor 25, and the fan 23 may be arranged in order just mentioned. The exhaust side duct 22 is one example of an exhaust path in a scope of the claims.

The fan 23 suctions and exhausts the air at surroundings of the image formation section 12 to thereby perform ventilation inside of the image forming apparatus 10. The air exhausted by the fan 23 passes through the filter 24.

Receiving the air flowing through the filter 24, the fine particle sensor 25 detects an amount of the particles contained in this air, that is, an amount of the particles such as the non-transferred toner and the ultrafine particles released from the material exposed to the high temperature, and outputs, to a control section 31, a detection signal indicating the amount of these particles (hereinafter referred to as a contamination level K of the air). A typically used particle detection sensor is applicable as the fine particle sensor 25. The fine particle sensor 25 is one example of a contamination detection section in the scope of the claims.

The first opening and closing valve 26 is moved rotationally around a support shaft 26A of the first opening and closing valve 26 by an actuator 27 to fully open or fully close the exhaust port 22A of the exhaust side duct 22 or adjust opening thereof. The first opening and closing valve 26 is one example of an air amount adjustment section in the scope of the claims.

A temperature sensor 28 is provided at surroundings of the image formation section 12. The temperature sensor 28 detects a temperature T of the surroundings of the image formation section 12, and outputs a detection signal indicating the temperature T of the surroundings to the control section 31. The temperature sensor 28 is one example of a temperature detection section in the scope of the claims.

A circulation duct 29 is connected to the exhaust side duct 22. The circulation duct 29 has an opening part on an exhaust side of the filter 24 in the exhaust side duct 22 and also on a more downstream side of the air flow than the fine particle sensor 25, and extends from the aforementioned opening part towards a suction side of the fan 23 and is connected to a suction side of the fan 23, also having an opening part at this position. The circulation duct 29 is one example of a circulation path in the scope of the claims.

With such configuration, upon driving of the fan 23 in a state in which the first opening and closing valve 26 is fully open, a flow of the air in a direction of an arrow E is generated at the suction side duct 21 and the exhaust side duct 22. This air passes through an inside of the image formation section 12, cooling the image formation section 12. The image formation section 12 is provided with the photoconductive drum 4, a developing device which develops the electrostatic latent image formed on the surface of the photoconductive drum 4, etc. Therefore, upon an increase in the temperature of the surroundings of the image formation section 12, the toner stored in the developing device, the non-transferred toner removed from the surface of the photoconductive drum 4, etc. melt. Thus, it is effective to cool the image formation section 12 by the fan 23.

Through the air flowing through the exhaust side duct 22, the filter 24 captures and removes the particles contained in this air. Then the air from which these particles have been removed is discharged to the outside of the image forming apparatus 10 from the exhaust port 22A of the exhaust side duct 22. Consequently, contamination in the apparatus is decreased, preventing environment contamination.

Upon driving of the fan 23 in a state in which the first opening and closing valve 26 is fully closed, the air is not exhausted from the exhaust port 22A in the exhaust side duct 22, increasing an air pressure on a more downstream side of the air flow than the filter 24 and the fine particle sensor 25 while decreasing the air pressure on a more upstream side of the air flow (a suction side of the fan 23) than the fan 23. Thus, an air flow in a direction of an arrow F is generated in the circulation duct 29, whereby the air flows from the more downstream side of the air flow than the filter 24 and the fine particle sensor 25 towards the more upstream side of the air flow than the fan 23 through the circulation duct 29. Consequently, the air repeatedly flows through a circulation path: the fan 23 to the filter 24 to the fine particle sensor 25 to the circulation duct 29 to the fan 23 and the air repeatedly passes through the filter 24, resulting in an increase in a ratio of capturing the particles contained in the air by the filter 24. As a result, the contamination in the apparatus is sufficiently decreased.

Furthermore, upon driving of the fan 23 in a state in which the opening of the first opening and closing valve 26 is set appropriately, the air is discharged from the exhaust port 22A of the exhaust side duct 22 towards the outside and the air also flows through the circulation path described above. In this case, an amount of the air discharged from the exhaust port 22A of the exhaust side duct 22 towards the outside becomes increasingly larger with an increase in the opening of the first opening and closing valve 26, decreasing the amount of the air flowing through the circulation path described above. On the contrary, the amount of the air discharged from the exhaust port 22A of the exhaust side duct 22 towards the outside becomes increasingly smaller with a decrease in the aperture of the first opening and closing valve 26, increasing the amount of the air flowing through the circulation path described above. That is, the amount of the air discharged from the exhaust port 22A of the exhaust side duct 22 towards the outside and the amount of the air flowing through the circulation path described above increase and decrease oppositely to each other.

Thus, appropriately setting the opening of the first opening and closing valve 26 makes it possible to accurately adjust efficiency of cooling the image formation section 12 and the ratio of capturing the particles contained in the air by the filter 24.

Here, the temperature sensor 28 detects the temperature T of the surroundings of the image formation section 12, and outputs a detection signal indicating this temperature T of the surroundings to the control section 31.

In a state in which the fan 23 is driven to generate an air flow, the fine particle sensor 25 detects an amount of particles flowing through the filter 24 and contained in the air, and outputs a detection signal indicating the contamination level K of the air to the control section 31.

Upon input of the detection signal outputted from the fine particle sensor 25 and the detection signal outputted from the temperature sensor 28, the control section 31 drives the fan 23 and the actuator 27 based on the contamination level K of the air and the temperature T of the surroundings of the image formation section 12 indicated by these detection signals to fully open or fully close the first opening and closing valve 26 or adjust opening of the first opening and closing valve 26. Consequently, as described above, the amount of the air discharged from the exhaust port 22A of the exhaust side duct 22 to the outside and the amount of the air flowing through the circulation path described above increase and decrease oppositely to each other, appropriately adjusting the efficiency of cooling the image formation section 12 and the ratio of capturing the particles contained in the air by the filter 24.

The control section 31 can control the image formation section 12 to control a speed (a process speed) of image formation performed by the image formation section 12, and based on the temperature T of the surroundings of the image formation section 12 indicated by the detection signal of the temperature sensor 28, sets a cooling mode in which the speed of the image formation performed by the image formation section 12 decreases. In the cooling mode, the control section 31 lowers a speed of recording paper conveyance to thereby decrease an amount of heat generation for fixing the toner image on the recording paper in the fixing device 15. Consequently, an increase in the temperature of the surroundings of the image formation section 12 is suppressed whereby contamination in the apparatus is decreased. Note that, however, a number of pieces of recording paper per unit time, that is, productivity is decreased.

Figure 3:
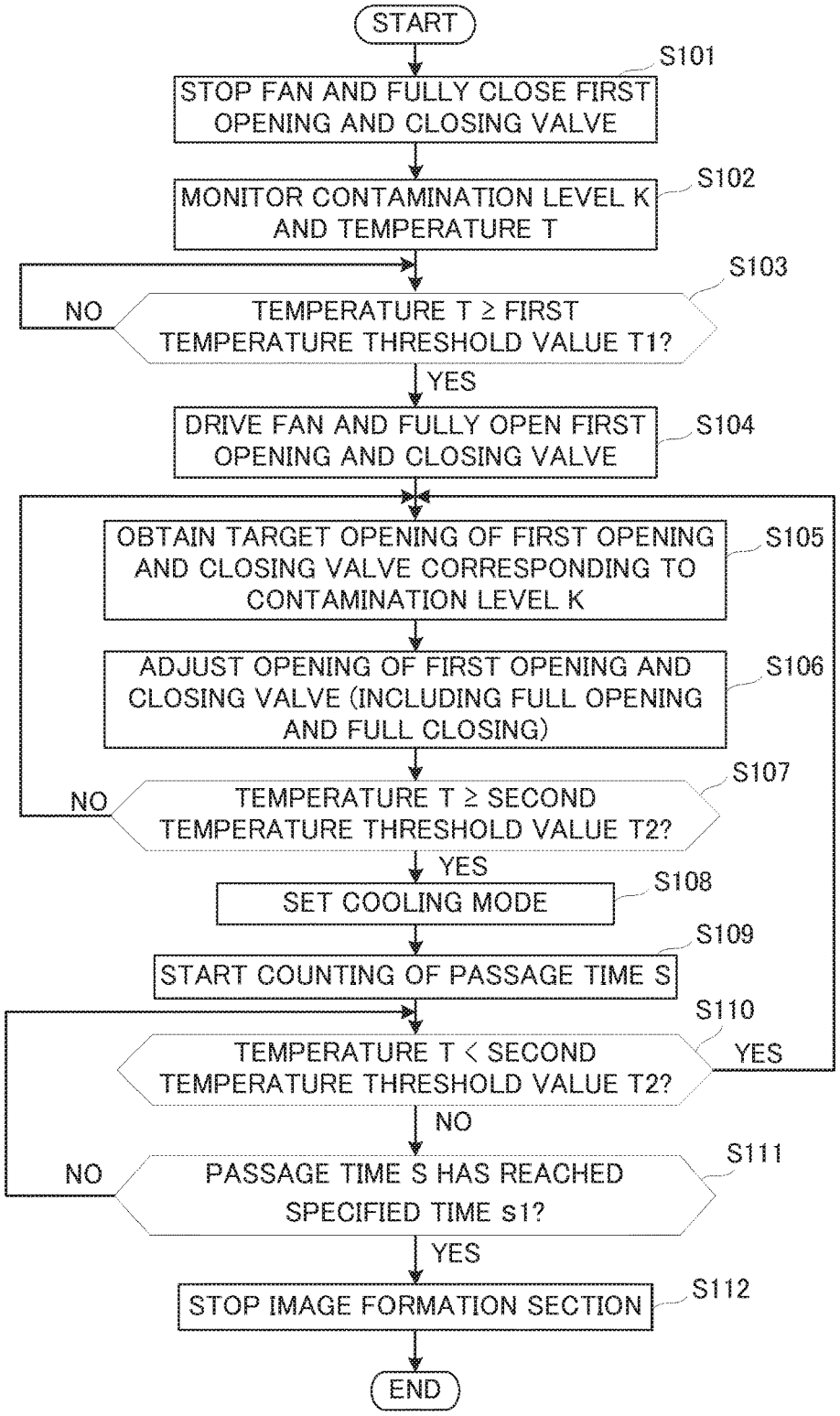
FIG. 3 is a flowchart illustrating procedures of controlling a fan and a first opening and closing valve and procedures of setting a cooling mode.

Next, procedures of controlling the fan 23 and the first opening and closing valve 26 by the control section 31 and procedures of setting the cooling mode will be described with reference to a flowchart illustrated in FIG. 3.

First, the fan 23 is stopped and the first opening and closing valve 26 is in a fully closed state during operation immediately after the image forming apparatus 10 is activated (step S101). In this state, the detection signal outputted from the fine particle sensor 25 and the detection signal outputted from the temperature sensor 28 are inputted to the control section 31, and the control section 31 monitors the contamination level K of the air and the temperature T of the surroundings of the image formation section 12 indicated by these detection signals (step S102).

Then the control section 31 determines whether or not the temperature T of the surroundings of the image formation section 12 has become equal to or greater than a preset first temperature threshold value t1 (step S103). Upon determination that the temperature T has become equal to or greater than the first temperature threshold value t1 (Yes in step S103), the control section 31 drives the actuator 27 of the first opening and closing valve 26 to turn the first opening and closing valve 26 into a fully open state and drive the fan 23 (step S104). Consequently, the air flow in the direction of the arrow E is generated in the suction side duct 21 and the exhaust side duct 22, cooling the image formation section 12 and suppressing an increase in the temperature T.

Subsequently, in the state in which the fan 23 is driven and the first opening and closing valve 26 is fully open, the control section 31 obtains target opening of the first opening and closing valve 26 corresponding to the contamination level K of the air flowing through the filter 24 (step S105), drives the actuator 27 of the first opening and closing valve 26, and sets the opening of the first opening and closing valve 26 as the obtained target opening (step S106).

More specifically, the control section 31 sets the target opening of the first opening and closing valve 26 higher with a decrease in the contamination level K of the air flowing through the filter 24 to increase the opening of the first opening and closing valve 26. At this point, when the target opening of the first opening and closing valve 26 is set at a maximum, the first opening and closing valve 26 is fully opened. Consequently, the amount of the air discharged from the exhaust port 22A of the exhaust side duct 22 to the outside increases, whereby the amount of the air repeatedly flowing through the circulation path described above is decreased or the amount reaches zero. As a result, the amount of the air flowing through the surroundings of the image formation section 12 increases, increasing the efficiency of cooling the image formation section 12.

The control section 31 sets the target opening of the first opening and closing valve 26 smaller with an increase in the air contamination level K of the air flowing through the filter 24 to decrease the opening of the first opening and closing valve 26. Consequently, the amount of the air discharged from the exhaust port 22A of the exhaust side duct 22 to the outside decreases and the amount of the air flowing through the circulation path described above increases. That is, most of the air flowing through the exhaust side duct 22 is returned to the exhaust side duct 22 through the circulation duct 29 (flows through the circulation path described above) and passes through the filter 24 a plurality of times. As a result, the ratio of capturing the particles contained in the air by the filter 24 increases, decreasing the contamination in the apparatus.

Further, when the contamination level K of the air has become equal to or greater than a preset contamination level threshold value k1 as a result of an increase in the contamination level K of the air flowing through the filter 24, the control section 31 sets the target opening of the first opening and closing valve 26 at "0" to fully close the first opening and closing valve 26. In this case, all the air flowing through the exhaust side duct 22 is returned to the exhaust side duct 22 through the circulation duct 29 (flows through the circulation path described above) and repeatedly pass through the filter 24. As a result, the ratio of capturing the particles contained in the air by the filter 24 increases, decreasing the contamination in the apparatus. Moreover, the air is not discharged from the exhaust port 22A of the exhaust side duct 22 to the outside, preventing the environmental contamination.

In a state in which the fan 23 is driven and the opening of the first opening and closing valve 26 is appropriately adjusted in the manner described above, the control section 31 determines whether or not the temperature T of the surroundings of the image formation section 12 has become equal to or greater than a preset second temperature threshold value t2 (t2>t1) which is higher than the first temperature threshold value t1 described above (step S107). Upon determination that the temperature T of the surroundings of the image formation section 12 has become equal to or greater than the second temperature threshold value t2 (Yes in step S107), the speed (process speed) of the image formation performed by the image formation section 12 is decreased to set the image forming apparatus 10 in a cooling mode (step S108). Consequently, the speed of the recording paper conveyance decreases, suppressing an amount of heat generation for fixing the toner image on the recording paper in the fixing device 15 and suppressing an increase in the temperature of the surroundings of the image formation section 12. This cooling mode is set based on the temperature T of the surroundings of the image formation section 12 regardless of the opening (including full opening and full closing) of the first opening and closing valve 26.

Further, the control section 31 starts to count passage time S which has passed since start of the setting of the cooling mode (step S109), and determines whether or not the temperature T of the surroundings of the image formation section 12 has become lower than the second temperature threshold value t2 (step S110) and also determines whether or not the passage time S has reached a preset specified time s1 (step S111). Then before the passage time S reaches the specified time s1 (No in step S111), when the temperature T has become lower than the second temperature threshold value t2 (Yes in step S110), the control section 31 returns to processing from step S105 to drive the fan 23 and appropriately adjust the opening of the first opening and closing valve 26.

Moreover, when the temperature T is not lower than the second temperature threshold value t2 (No in step S110) and the passage time S has reached the specified time s1 (Yes in step S111), the control section 31 stops the image formation section 12 (step S112). Consequently, the contamination in the apparatus and the environmental contamination can reliably be prevented.

Note that discharge of ultrafine particles (UFP) from an image forming apparatus has become a problem in recent years. Moreover, a temperature at which a toner image on recording paper is fixed needs to be decreased to decrease power consumption and a toner melting point is set low, thus requiring efficient cooling of an inside of the image forming apparatus.

Thus, it is preferable to take in the fine particles by the fan and capture the fine particles by the filter as described above but also to simultaneously cool the inside of the image forming apparatus. However, with an increase in a thickness of the filter, while the rate of capturing the fine particles improves, the amount of the air flowing through the filter decreases, leading to deterioration in the cooling efficiency. On the contrary, with a decrease in the thickness of the filter, the amount of the air flowing through the filter increases and the cooling efficiency improves while decreasing the ratio of capturing the fine particles. Therefore, the ratio of capturing the fine particles and the cooling efficiency are in trade-off relationship.

Moreover, an amount of ultrafine particles discharged from the image forming apparatus and an inner temperature of the image forming apparatus vary as needed. Therefore, such a technology that maintains the ratio of capturing the ultrafine particles and the cooling efficiency in the trade-off relationship at preferable levels is required.

On the contrary, in this embodiment, the ratio of capturing the fine particles and the cooling efficiency which are in the trade-off relationship can adequately be adjusted while performing both the cooling of the image formation section 12 and the capturing of the particles contained in the air by the fan 23 and the filter 24. Moreover, when the temperature T of the surroundings of the image formation section 12 has become equal to or greater than the second temperature threshold value t2, the cooling mode is set, thus makes it possible to reliably prevent the contamination in the apparatus and the environmental contamination.

Figure 4:
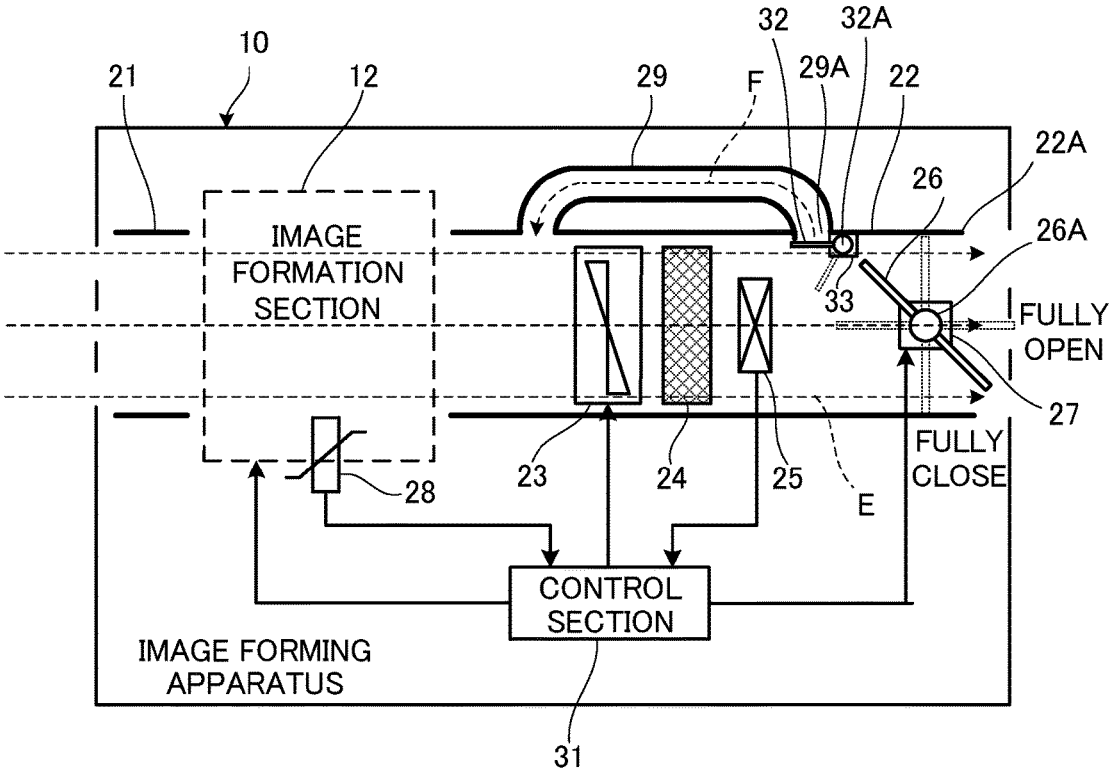
FIG. 4 is a sectional view schematically illustrating a modified example of the ventilation mechanism of the image formation section in the image forming apparatus of this embodiment.

FIG. 4 is a sectional view schematically illustrating a modified example of a mechanism of ventilation of the image forming apparatus 10 by the fan 23. In this modified example, a second opening and closing valve 32 is added to the ventilation mechanism of the image forming apparatus 10 illustrated in FIG. 2.

This second opening and closing valve 32 is provided at an inflow port 29A serving as an opening part of the circulation duct 29. The second opening and closing valve 32 is moved by an actuator 33 rotationally around a support shaft 32A of the second opening and closing valve 32 to fully open or fully close the inflow port 29A or adjust opening thereof, adjusting an amount of the air flowing into the circulation duct 29 through the inflow port 29A.

The control section 31 increases the opening of the first opening and closing valve 26 with a decrease in the contamination level K of the air flowing through the filter 24 as described above. Then the control section 31 decreases the opening of the second opening and closing valve 32 with an increase in the opening of the first opening and closing valve 26. Consequently, when the amount of the air discharged from the exhaust port 22A of the exhaust side duct 22 to the outside has increased, the amount of the air flowing into the circulation duct 29 is reliably decreased.

Moreover, the control section 31 decreases the opening of the first opening and closing valve 26 with an increase in the contamination level K of the air flowing through the filter 24 as described above. Then the control section 31 increases the opening of the second opening and closing valve 32 with a decrease in the opening of the first opening and closing valve 26. Consequently, when the amount of the air discharged from the exhaust port 22A of the exhaust side duct 22 to the outside has decreased, the amount of the air flowing into the circulation duct 29 is reliably increased.

The embodiment has been described above, referring to a color printer as the image forming apparatus according to this disclosure, referring to a color printer, but this is just one example and any other image forming apparatus such as a monochromatic printer or a different electronic device, for example, a multifunction peripheral, a copier, or a facsimile device may be used.

Moreover, configuration and processing described with reference to FIGS. 1 to 4 are each one embodiment or a modified example of this disclosure, but this disclosure is not limited in any way to the configuration and the processing.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image formation section forming a toner image on recording paper;

a fan suctioning and exhausting air at surroundings of the image formation section for ventilation;

a filter permitting the air exhausted by the fan to pass through the filter;

a contamination detection section detecting a contamination level of the air which has passed through the filter;

an exhaust path discharging the air, which has passed through the filter, to an outside;

a circulation path returning the air, which has passed through the filter, towards a suction side of the fan without discharging the air to the outside;

an air amount adjustment section increasing and decreasing an amount of the air flowing through the exhaust path and an amount of the air flowing through the circulation path oppositely to each other; and a control section controlling the air amount adjustment section in accordance with the contamination level of the air detected by the contamination detection section to increase and decrease the amount of the air flowing through the exhaust path and the amount of the air flowing through the circulation path oppositely to each other.

2. The image forming apparatus according to claim 1, wherein the control section controls the air amount adjustment section to decrease the amount of the air flowing through the exhaust path and increase the amount of the air flowing through the circulation path with an increase in the contamination level of the air detected by the contamination detection section.

3. The image forming apparatus according to claim 1, wherein the fan and the filter are arranged in the exhaust path, and the exhaust path is provided with an exhaust port for exhausting the air, which has passed through the filter, to the outside, the circulation path is a path connecting together an exhaust side of the filter and the suction side of the fan in the exhaust path, and the air amount adjustment section is a first opening and closing valve adjusting an amount of the air discharged from the exhaust port in the exhaust path to the outside.

4. The image forming apparatus according to claim 3, wherein the control section decreases opening of the first opening and closing valve to decrease the amount of the air flowing through the exhaust path and also increase the amount of the air flowing through the circulation path with an increase in the contamination level of the air detected by the contamination detection section.

5. The image forming apparatus according to claim 3, wherein the air amount adjustment section includes a second opening and closing valve opening and closing an opening part at which the air flows from the exhaust side of the filter in the exhaust path to the circulation path to adjust an amount of the air flowing from the exhaust side of the filter into the circulation path, and the control section decreases the opening of the first opening and closing valve and increases opening of the second opening and closing valve with an increase in the contamination level of the air detected by the contamination detection section to decrease the amount of the air flowing through the exhaust path and also increase the amount of the air flowing through the circulation path.

6. The image forming apparatus according to claim 5, wherein the control section increases the opening of the first opening and closing valve and decreases the opening of the second opening and closing valve to increase the amount of the air flowing through the exhaust path and also decrease the amount of the air flowing through the circulation path with a decrease in the contamination level of the air detected by the contamination detection section.

7. The image forming apparatus according to claim 3, wherein when the contamination level of the air detected by the contamination detection section has become higher than a preset contamination level threshold value, the control section closes the first opening and closing valve, blocks the flow of the air through the exhaust path, and generates a flow of the air through the circulation path.

8. The image forming apparatus according to claim 3, wherein the control section increases the opening of the first opening and closing valve to increase the amount of the air flowing through the exhaust path and also decrease the amount of the air flowing through the circulation path with a decrease in the contamination level of the air detected by the contamination detection section.

9. The image forming apparatus according to claim 1, further comprising a temperature detection section detecting a temperature of surroundings of the image formation section, wherein when the temperature of the surroundings of the image formation section detected by the temperature detection section has become equal to or greater than a preset first temperature threshold value, the control section drives the fan and controls the air amount adjustment section in accordance with the contamination level of the air detected by the contamination detection section to increase and decrease the amount of the air flowing through the exhaust path and the amount of the air flowing through the circulation path oppositely to each other, and when the temperature of the surroundings of the image formation section detected by the temperature detection section has become equal to or greater than a preset second temperature threshold value higher than the first temperature threshold value, the control section sets a cooling mode for decreasing a speed of image formation performed by the image formation section or stops the image formation section.

10. The image forming apparatus according to claim 9, wherein when passage time from start of the cooling mode setting has reached a preset specified time without a decrease in the temperature of the surroundings of the image formation section below the second temperature threshold value, the control section stops the image formation section.

* * * * *